US007516581B2

(12) United States Patent
Vidal

(10) Patent No.: US 7,516,581 B2
(45) Date of Patent: Apr. 14, 2009

(54) SPLIT DOOR FRAME ASSEMBLY

(76) Inventor: Rolando Vidal, 100 Broad Brook Rd., Bedford Hills, NY (US) 10507

( * ) Notice: Subject to any disclaimer, the term of this patent is extended or adjusted under 35 U.S.C. 154(b) by 294 days.

(21) Appl. No.: 11/127,890

(22) Filed: May 12, 2005

(65) Prior Publication Data

US 2006/0254163 A1 Nov. 16, 2006

(51) Int. Cl.
*E04B 1/04* (2006.01)
*E04C 2/38* (2006.01)

(52) U.S. Cl. ..... 52/204.1; 52/656.4

(58) Field of Classification Search ..... 52/212, 52/217, 205.54, 717.01, 204.1, 656; 49/505; 248/220.22, 221.11, 222.11, 225.11
See application file for complete search history.

(56) References Cited

U.S. PATENT DOCUMENTS

| | | | | | |
|---|---|---|---|---|---|
| 2,597,841 | A | * | 5/1952 | Ridgway | 296/29 |
| 2,853,161 | A | | 9/1958 | Mascari | |
| 3,420,003 | A | | 1/1969 | Cline | |
| 3,545,135 | A | * | 12/1970 | Lieber | 49/505 |
| 3,654,734 | A | * | 4/1972 | Lehman | 49/505 |
| 3,788,019 | A | * | 1/1974 | Kiselewski | 52/212 |
| 3,906,671 | A | * | 9/1975 | Maldonado | 49/505 |
| 4,179,849 | A | * | 12/1979 | Kuffner | 49/505 |
| 4,791,758 | A | | 12/1988 | Bauer et al. | |
| 4,813,204 | A | * | 3/1989 | Rentschler | 52/217 |
| 4,878,325 | A | * | 11/1989 | Van Tuyl et al. | 52/217 |
| 4,912,879 | A | * | 4/1990 | Mozuras et al. | 49/505 |
| 5,203,130 | A | * | 4/1993 | Freelove | 52/211 |
| 5,528,869 | A | * | 6/1996 | Boomer et al. | 52/212 |
| 5,711,120 | A | * | 1/1998 | Karpen | 52/212 |
| 5,934,030 | A | * | 8/1999 | McDonald | 52/204.1 |
| 6,550,193 | B2 | | 4/2003 | Potts | |
| 2004/0182040 | A1 | * | 9/2004 | Schiedegger et al. | 52/717.01 |

* cited by examiner

*Primary Examiner*—Brian E. Glessner
*Assistant Examiner*—Adriana Figueroa
(74) *Attorney, Agent, or Firm*—Ostrolenk, Faber, Gerb & Soffen, LLP

(57) ABSTRACT

A split door frame assembly, including: a hinge jamb, a strike jamb and a header that connects the hinge jamb to the strike jamb. The hinge jamb, the strike jamb and the header each formed by a stop element and a trim element. The stop element is substantially L-shaped with a short leg and a long leg. The long leg has a first member, a second member, a first wall, a second wall, and a joining wall extending between the ends of the first and second walls. The joining wall is parallel to the first and second members. The second wall has a plurality of apertures spaced along its length. The trim element is an L-shaped member wherein a first leg of the L-shape forms an outer trim flange and a second leg of the L-shape extends 90° from the trim flange and has projections at its free end which are engagable in the apertures in the second wall.

14 Claims, 3 Drawing Sheets

SPLIT DOOR FRAME ASSEMBLY

BACKGROUND OF THE INVENTION

The present invention relates to door frames, and particularly to metal door frames traditionally used in the construction of office buildings.

Conventionally, metal door frames are pre-manufactured and shipped to a building site fully assembled. The door frame is then placed in a rough opening in the wall and the wall must be built up to the door frame. Since the metal door frame includes the trim, which is intended to overlap the wall surface on both sides of the wall in which the frame is mounted, it is difficult to obtain a clean appearance of the wall around the door frame since the wall must be built up to fit the frame.

Various types of split door frames are known in the art and reference is made to the following patents: U.S. Pat. No. 4,791,758; U.S. Pat. No. 6,550,193; U.S. Pat. No. 4,878,325; U.S. Pat. No. 3,420,003; U.S. Pat. No. 2,853,161; U.S. Pat. No. 4,912,879; U.S. Pat. No. 4,813,204; and U.S. Pat. No. 3,906,671. All of these patents deal with multiple part door frames which allow adjustment of the frame to the width of the wall forming the opening. All of these designs are of varying degrees of complexity which, in applicant's opinion, is the reason why none of them have found commercial success. Furthermore, most of these designs require numerous assembly steps which are necessary for mounting the frame to the wall and adjusting the width of the frame. U.S. Pat. No. 4,791,758 discloses an expandable split door frame that has a first part with an outer flange, a biasing member and a lipped cover that forms a channel. The second member has a lipped inner segment that is slidably arranged in the channel. The second member also has an outer flange for mounting against the wall.

U.S. Pat. No. 6,550,193 discloses a split jam for doors and windows, wherein the jam has a support frame and a trim frame. The support frame is attached to the rough opening of the door frame and then the trim frame is attached to the support frame, for example, by screws.

U.S. Pat. No. 4,878,325 discloses a two-piece adjustable metal door frame which utilizes a fairly complex arrangement of screws, slots and brackets which allows the door frame's width to be adjusted.

U.S. Pat. No. 3,420,003 discloses an adjustable door frame made up of three parts which require relatively precisely produced components, such as the teeth, that serve to hold the trim part in place.

U.S. Pat. No. 2,853,161 discloses a door frame that has an adjustable ratchet arrangement that connects the parts of the frame together.

U.S. Pat. No. 4,912,879 teaches a door frame assembly that utilizes a clip to mount the trim part of the frame to the support part of the frame.

U.S. Pat. No. 4,813,204 teaches a door jam assembly having two parts that slide relative to one another wherein both parts of the frame must be separately fixed to the wall structure.

Finally, U.S. Pat. No. 3,906,671 teaches an adjustable door frame with a support part, a trim part that slides behind the door stop of the support part so as to be connected thereto via screws, and a stop member that snaps over the clip in which the screw heads are located.

As previously mentioned, all these designs require a number of assembly steps for mounting the door frame in the wall opening.

SUMMARY OF THE INVENTION

Accordingly, it is an object of the present invention to provide a metal door frame assembly that is of simple construction and allows the two parts of the door assembly to be mounted together with a minimal number of steps. Furthermore, it is another object of the invention to provide a door frame assembly that allows the rough opening to be made closer to the final opening size of the door, thereby avoiding the need for building up the wall to meet with the door frame.

Pursuant to these objects, and others which will become apparent hereafter, one aspect of the present invention resides in a split door frame assembly having a hinge jamb, a strike jamb and a header that connects the hinge jamb to the strike jamb. The hinge jamb, the strike jamb and the header are each formed by a stop element and a trim element. The stop element is substantially L-shaped with a short leg of the L-shape forming an outer trim flange and a long leg of the L-shape extending 90° from the short leg. The long leg has a first member that extends from the trim flange, a second member arranged in a common plane with the first member and spaced therefrom, a first wall extending 90° from an end of the first member facing the second member, a second wall extending 90° from an end of the second member facing the first member, the first and second walls being parallel to the trim flange and extending in a common direction, and a joining wall extending between the ends of the first and second walls. The joining wall is parallel to the first and second members. The second wall has a plurality of apertures spaced along its length and in a region of the second member. The trim element is an L-shaped member wherein a first leg of the L-shape forms an outer trim flange and a second leg of the L-shape extends 90° from the trim flange and has projections at its free end which are engagable in the apertures in the second wall.

In another embodiment, a bracket is attached to back surfaces of the first and second members so as to extend across a gap formed by the first and second walls and so as to reinforce the long leg of the stop element.

In a further embodiment, four of the apertures are provided in the second wall of both the hinge jamb and at the strike jamb. Preferably, the apertures are formed as slots.

In still another embodiment of the door frame assembly, the projections of the trim element are formed as tabs. An edge of each of the tabs has a hook-shape so as to be engagable in the slots. Alternatively, each tab has a side surface provided with a tooth that is engagable behind an inner edge of the slot when the tab is inserted in the slot.

The central joining wall of the hinge jamb and strike jamb is provided with a plurality of holes, in another embodiment, through which anchoring elements are receivable for anchoring the door frame to a stud wall.

Another embodiment of the door frame assembly provides the second member of the hinge jamb and the strike jamb with a plurality of holes for accepting anchoring elements for mounting the door frame to a wall. The holes are arranged so that the second leg of the trim element covers the holes when the trim element is mounted to the stop element.

The door frame assembly can be made of metal or a composite material such as fiberglass.

Other features and advantages of the present invention will become apparent from the following description of the invention that refers to the accompanying drawings.

DETAILED DESCRIPTION OF THE INVENTION

Figure 1:
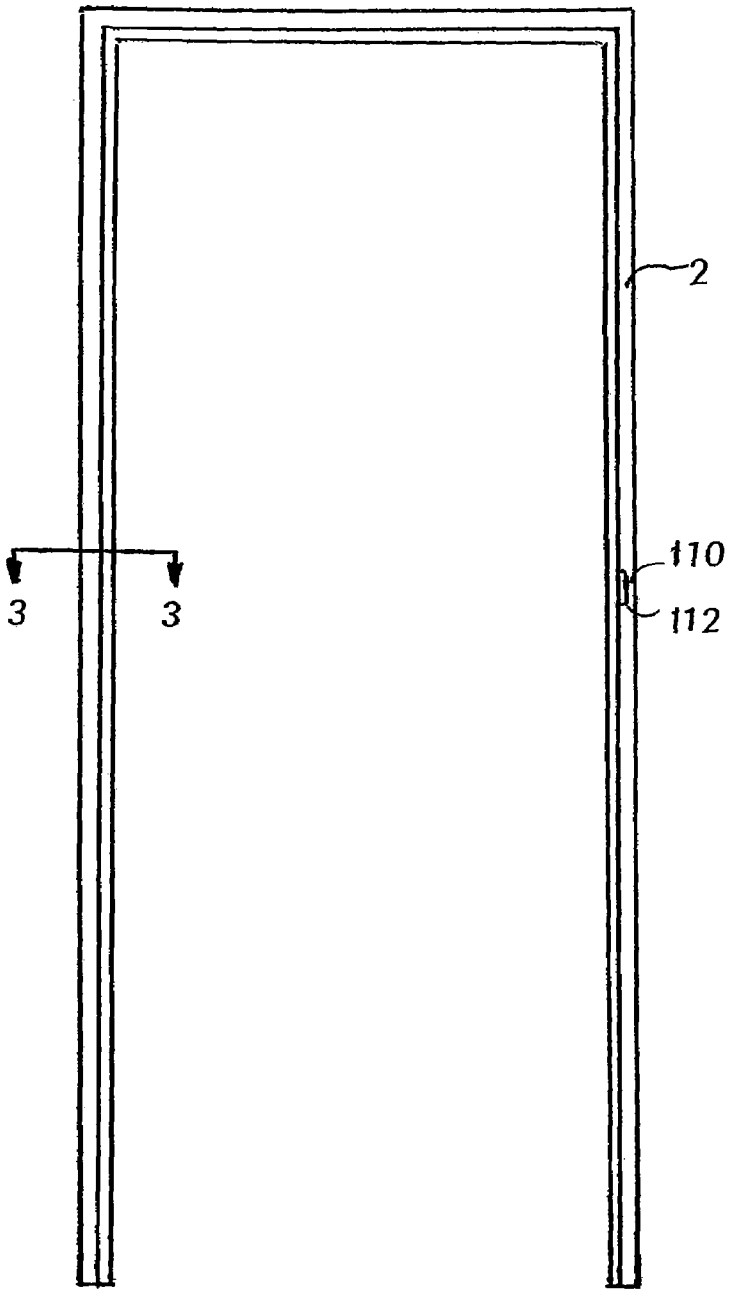
FIG. 1 is a front view of the inventive door frame.
Figure 2:
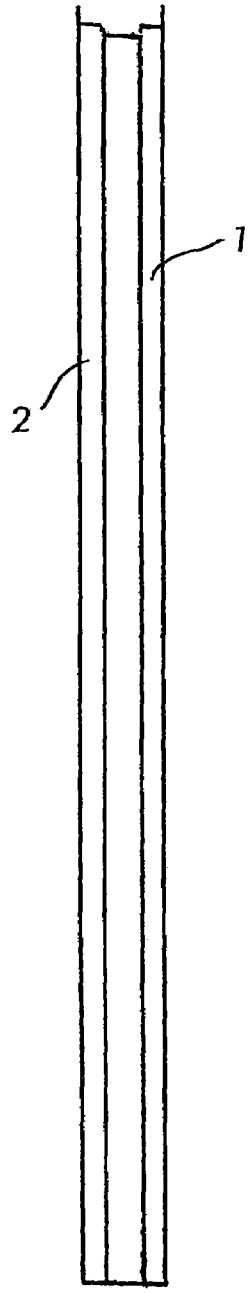
FIG. 2 is a side view of the door frame.
Figure 3:
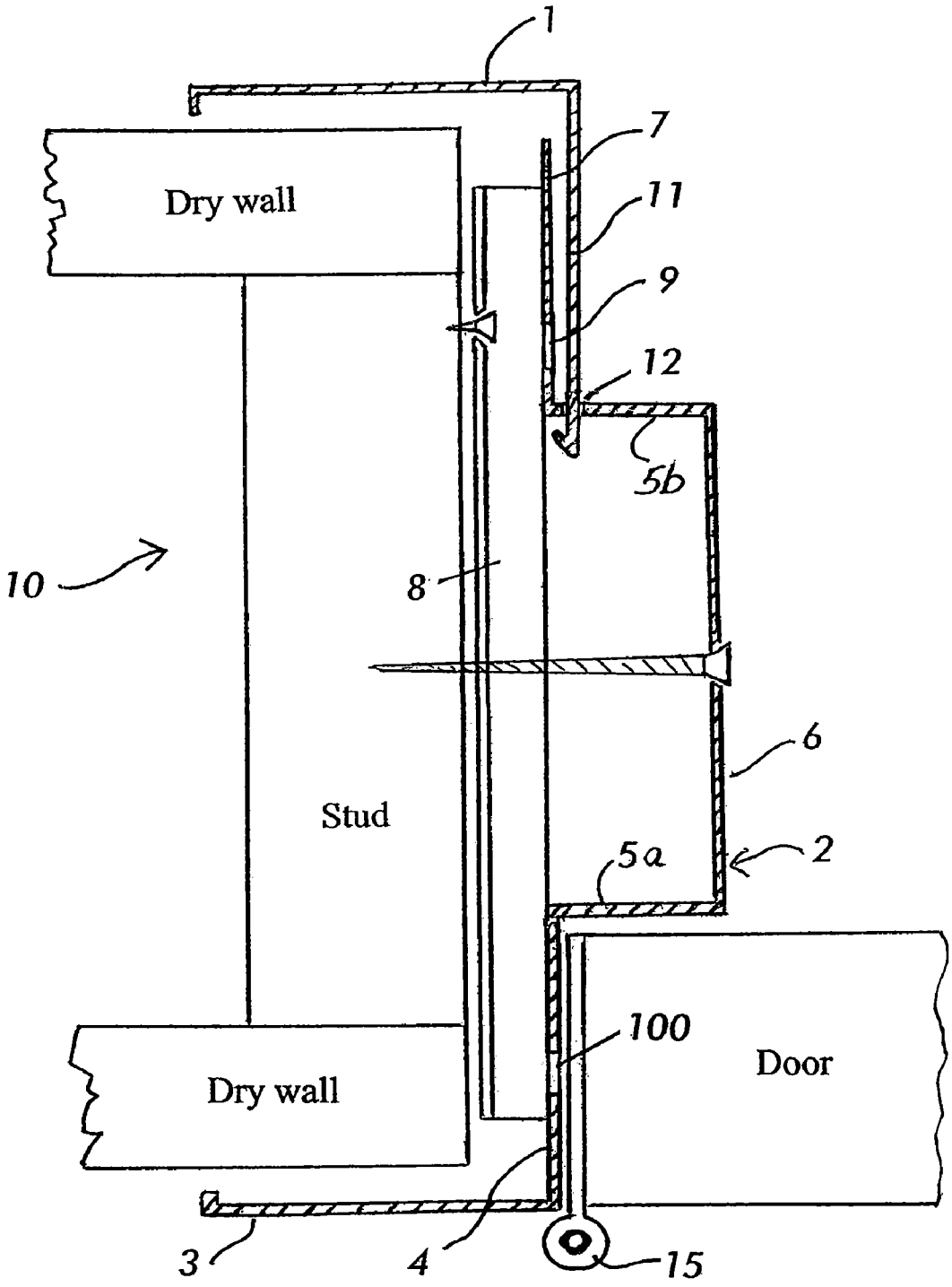
FIG. 3 is a cross-section through the hinge jamb of the door frame.

As can be seen in FIGS. 1 and 2, the inventive door frame includes a hinge jamb, a strike jamb and a header. FIG. 3 is a cross-section through the hinge jamb and is also representative of the strike jamb and the header. The hinge jamb, strike jamb and header each have two main components, namely a trim element 1 and a stop element 2. The stop element 2 has an outer flange 3 that forms the outer trim of the door frame. This outer trim extends completely around the door frame and, when installed in a rough opening rests against a surface of the wall 10 forming the rough opening. A first member 4 extends 90° from the outer trim member 3 and forms a surface on which the door hinges 15 are mounted. In order to facilitate mounting of the door hinge, it is possible to provide threaded screw holes 100 at the locations where the door hinges are to be mounted. Of course the strike jamb is not provided with holes for mounting hinges. Instead the first member 4 of the strike jamb can be provided with screw holes 110 and a cutout 112 for mounting a strike-plate, as is known in the art. The header is left without any additional holes for mounting hinges or a strike-plate. The first member 4 extends inwardly from the outer trim member 3 up to a stop member that has two spaced apart walls 5*a*, 5*b* that are parallel to the outer trim member 3 and which are connected by a central joining wall 6 that is parallel to the first member 4. Projecting from the wall 5*b* furthest from the first member 4, is a second member 7 that is in the same plane as the first member 4. A support bracket 8 is attached between the coplanar members 4, 7. The mounting support bracket 8 is, for example, welded to the members 4, 7 and serves to stabilize the frame element 2 and to form a mounting surface for mounting against the stud wall 10. A number of mounting brackets 8 are provided around the door frame, at least at locations where the door frame is to be secured to the wall.

The stop element 2 can be mounted to the wall 10, for example, by screws. For this purpose, a screw hole is provided in the connecting member 6. If it is desired to hide the elements which connect the door frame to the wall, a screw hole 9 can be provided in the member 7 and the support bracket 8 so that the screw can be screwed into the wall 10. It is not mandatory to provide screw holes in the header since the hinge jamb and the strike jamb will support the header.

Figure 4:
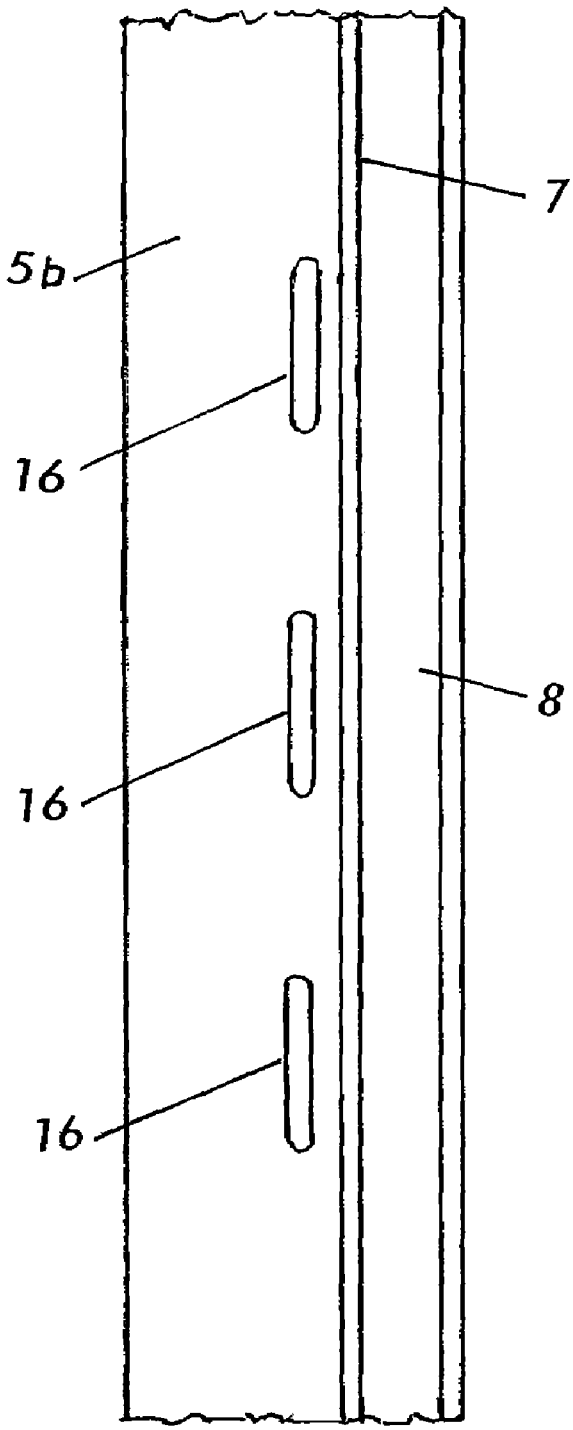
FIG. 4 is rear view of the door frame with the trim element removed.

Once the door frame stop element 2 is mounted to the wall, the L-shaped trim element 1 is attached to the stop element 2. For this purpose, the inwardly directed leg 11 of the trim element 1 is provided with tabs 12. Typically, four tabs would be provided on each vertical side of the door frame. For supporting the trim element 1, it is not necessary to provide tabs in the horizontal header portion of the door frame. The tabs engage in slots 16 provided in the wall 5*b* of the stop element 2 (see FIG. 4). The tabs are configured so as to lock in place in the slots. How such tabs can be constructed it would be within the purview of those skilled in the art. For example, the tabs can be hooked on their lower sides so as to slide down in the slot, or the tabs can have a prong on their rear side surface that snaps in the slot and prevents withdrawal from the slot once engaged. The other leg 12 of the trim element 1 is parallel to the outer surface of the wall 10 and contacts the surface once the element 1 is mounted to the element 2. By arranging the holes 9 for the mounting screws in the wall 7 of the element 2, the holes 9 are covered by the wall 11 so that the mounting means are not visible.

Next will be described the way in which the inventive door frame is mounted at a work site. To begin with, the wall is cut to a rough opening only slightly larger than the size of the door to be installed. The stop element 2 is then placed in the rough opening so that the outer trim member 3 rests against the outer surface of the wall 10. Once the frame element 2 is plumb, it is secured to the wall with screws. Once the stop element 2 is securely mounted to the wall, the tabs 12 of the trim element are inserted into the slots of the stop element 2 so as to hold the trim element 1 in place against the surface of the wall 10.

As is evident, the present invention provides a simple construction that allows assembly of the door frame with a minimal number of steps while at the same time avoiding the need to build up the wall to match the door frame since the rough opening is initially made to be much closer to the actual size of the door than was conventionally possible.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A split door frame assembly, comprising:

a hinge jamb;

a strike jamb and a header that connects the hinge jamb to the strike jamb, the hinge jamb, the strike jamb and the header each being formed by a stop element and a trim element, the stop element being substantially L-shaped with a short leg of the L-shape forming an outer trim flange and a long leg of the L-shape extending 90° to the short leg, the long leg having a first member that extends from the trim flange, a second member arranged in a common plane with the first member and spaced therefrom, a first wall extending 90° from an end of the first member facing the second member, a second wall extending 90° from an end of the second member facing the first member, the first and second walls being parallel to the trim flange and extending in a common direction, and a joining wall extending between the ends of the first and second walls, the joining wall being parallel to the first and second members, the second wall having a plurality of apertures spaced along its length and in a region of the second member, the trim element being an L-shaped member wherein a first leg of the L-shape forms an outer trim flange and a second leg of the L-shape extends 90° from the trim flange and has projections at its free end which are engagable in the apertures in the second wall.

2. The door frame assembly according to claim 1, wherein a bracket is attached to back surfaces of the first and second members so as to extend across a gap formed by the first and second walls and so as to reinforce the long leg of the stop element.

3. The door frame assembly according to claim 1, wherein four of the apertures are provided in the second wall of both the hinge jamb and at the strike jamb.

4. The door frame assembly according to claim 1, wherein the apertures are formed as slots.

5. The door frame assembly according to claim 4, wherein the projections of the trim element are formed as tabs.

6. The door frame assembly according to claim 5, wherein an edge of each of the tabs has a hook-shape so as to be engagable in the slots.

7. The door frame assembly according to claim 5, wherein each tab has a side surface provided with a tooth that is engagable behind an inner edge of the slot when the tab is inserted in the slot.

8. The door frame assembly according to claim 1, wherein the central joining wall of the hinge jamb and the strike jamb is provided with a plurality of holes through which anchoring elements are receivable for anchoring the door frame to a stud wall.

9. The door frame assembly according to claim 1, wherein the second member of the hinge jamb and the strike jamb is provided with a plurality of holes for accepting anchoring elements for mounting the door frame to a wall, the holes being arranged so that the second leg of the trim element covers the holes when the trim element is mounted to the stop element.

10. The door frame assembly according to claim 1, wherein the hinge jamb is provided with threaded holes in the first member, the threaded holes being arranged so as to correspond to hinge locations on a door to be mounted.

11. The door frame assembly according to claim 1, wherein the strike jamb has a cut-out and threaded holes into which a strike-plate is mountable.

12. The door frame assembly according to claim 1, wherein the door frame is made of metal.

13. The door frame assembly according to claim 1, wherein the door frame is made of a composite material.

14. The door frame assembly according to claim 13, wherein the door frame is made of fiberglass.

* * * * *